US005601135A

United States Patent [19]

Merrill

[11] Patent Number: 5,601,135

[45] Date of Patent: Feb. 11, 1997

[54] MOLD LOADING IN LOW-PRESSURE CASTING

[75] Inventor: Daniel L. Merrill, Montaque, Mich.

[73] Assignee: CMI International, Inc., Southfield, Mich.

[21] Appl. No.: 593,502

[22] Filed: Jan. 30, 1996

[51] Int. Cl.[6] ..... B22D 17/12

[52] U.S. Cl. ..... 164/306; 164/119

[58] Field of Search ..... 164/306, 312, 164/255, 119

[56] References Cited

U.S. PATENT DOCUMENTS 3,039,157 6/1962 Bobenmyer .
3,063,106 11/1962 Peirce .
4,932,461 6/1990 Schaffer et al. .
5,230,379 7/1993 Voss .

*Primary Examiner*—Kuang Y. Lin
*Attorney, Agent, or Firm*—Howard & Howard

[57] ABSTRACT

The subject invention is characterized by a mechanism for moving the tilt plate (45) laterally of the guide posts (38) to a loading position outside the operating area within the assembly so that the attachment surface faces sufficiently upwardly to allow a cope (36) and drag (34) defining a mold to rest thereon under the force of gravity. A plurality of crank arms (48) are fixed to and extend upwardly from one lateral edge of the tilt plate (45) to a distal end. A pair of hydraulic cylinders (51) are disposed above the movable platen (43) with a first connection (52) to the distal ends of the crank arms (48) and a second connection (53) to the movable platen (43) for rotating the crank arms (48) to thereby rotate the tilt plate (45) about a tilt axis (50) between an operating position within the assembly and the loading position outside the assembly and facing upwardly. A support ledge, defined by a plurality of removable stakes (46), extends upwardly from the attachment surface in the loading position for receiving and holding a mold against the force of gravity in the loading position while the mold is secured to the tilt plate (45) by cope clamps (47).

20 Claims, 15 Drawing Sheets

20
39
72
73
42
41
53
44
43
38
51
52
50
49
48
47
45
46
114
112
111
110
107
108
113
109
32
104
22

20
39
75
73
74
41
53
44
43
38
47
45
52
50
49
48
114
112
111
110
107
108
105
109
113
32
104
22

57
53
54
53
54
56
55
38
45
43

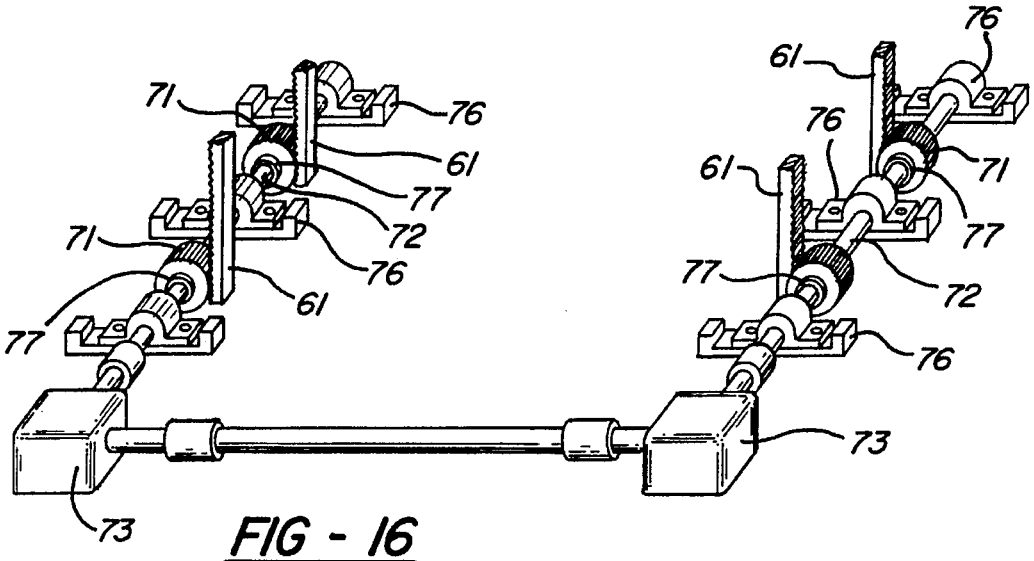
FIG - 16
FIG - 15
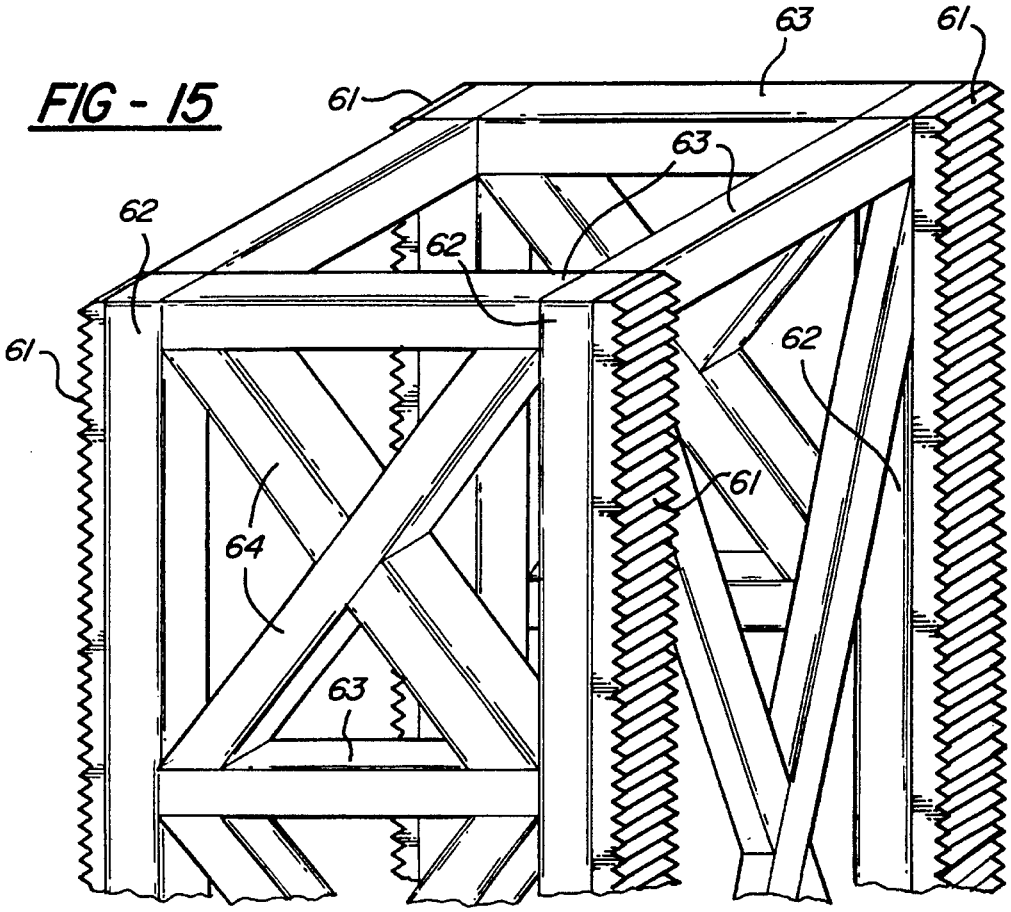

79
78
86
84
41
80
74
79

MOLD LOADING IN LOW-PRESSURE CASTING

TECHNICAL FIELD

The subject invention relates to low-pressure, permanent-mold casting wherein a mold made of metal is supported over and sealed to a crucible of an induction furnace and an inert or dry gas, under pressure, forces molten metal from the crucible up through a heated refractory riser stalk and into the mold cavity.

BACKGROUND OF THE INVENTION

The furnace and crucible are normally disposed in a pit and a casting machine moves laterally relative to the pit to position the mold over the crucible. The casting machine typically includes a vertically movable platen which opens and closes the mold for repetitive casting of metal parts. The casting machine is supported on a carriage for movement away from the crucible for changing molds or servicing the furnace, each mold comprising a lower drag and an upper cope. When the casting machine is positioned away from the crucible or over the crucible, the mold is loaded onto the movable platen with the drag and cope banded together. Thus, the drag is banded to the cope and is held thereto as the cope is attached to the movable platen. After the cope is secured to the movable platen, the movable platen is lowered to rest the drag upon a base plate of the machine. The banding is removed and the drag is secured to the base plate. The carriage includes a lift system for supporting the entire weight of the casting machine on the crucible for sealing the base plate to the crucible whereby the molten metal bath may be pressurized under the base plate. Thereafter the mold cavity defined by the drag and cope are opened and closed for repetitive casting of a series of parts.

It is very cumbersome to load an entire mold and attach it to the downwardly facing movable platen. The molds are large and very heavy, requiring the use of a fork lift truck, or the like, to move the mold into position for attachment to the movable platen. Due to the weight of the molds and the limited area within the casting machine, this loading process can be very cumbersome. In order to alleviate this difficult task, a prior art casting machine utilizes a tilt plate pivotally attached to the movable platen for movement through a limited 45° angle between a horizontal operating position and a downwardly and forwardly slanted position for cleaning and loading the mold. The tilt plate remains within the casting machine and faces downwardly in the loading position thereby requiring the mold to be hoisted up an held against the tilt plate while being secured thereto. Therefore the loading of the mold remains a cumbersome and difficult task.

SUMMARY OF THE INVENTION AND ADVANTAGES

The subject invention relates to a low-pressure casting apparatus for conveying molten metal upwardly from a molten metal bath to a mold thereabove and of the type including a base plate for supporting the drag of a mold above the molten metal bath with a plurality of guide posts extending upwardly from the base plate and defining an operating area therebetween; a fixed platen supported by the posts in fixed vertical spacing above the base and a movable platen guided for vertical movement in the operating area defined by and between the guide posts with a ram actuator interconnecting the fixed platen and the movable platen for moving the movable platen vertically on the guide posts. A tilt plate is operatively connected to the movable platen and presents a downwardly facing attachment surface under the movable platen in an operating position for supporting the cope of the mold under the movable platen. The apparatus is characterized by a mechanism for moving the tilt plate laterally of the guide posts to a loading position outside the operating area with the attachment surface facing sufficiently upwardly to allow a cope and drag defining a mold to rest thereon under the force of gravity.

Accordingly, the mold may be loaded unto the tilt plate and rest there under the force of gravity while being secured to the tilt plate. Since the tilt plate is outside the casting machine during loading, a wide variety of loaders may be employed; perhaps the most convenient of which are the overhead conveyor, trolley hoist or crane.

BRIEF DESCRIPTION OF THE DRAWINGS

Other advantages of the present invention will be readily appreciated as the same becomes better understood by reference to the following detailed description when considered in connection with the accompanying drawings wherein:

FIG. 15 is a perspective view of the rack frame;

FIG. 16 is perspective schematic view of one half of the synchronization drive system for the rack frame;

DETAILED DESCRIPTION OF THE PREFERRED EMBODIMENT

Referring to the Figures, wherein like numerals reference like or corresponding parts throughout the several views, an low-pressure casting apparatus for conveying metal upwardly from a molten metal bath is generally shown in FIGS. 1 through 8 with subassemblies and components shown in FIGS. 9 through 19.

Figure 8:
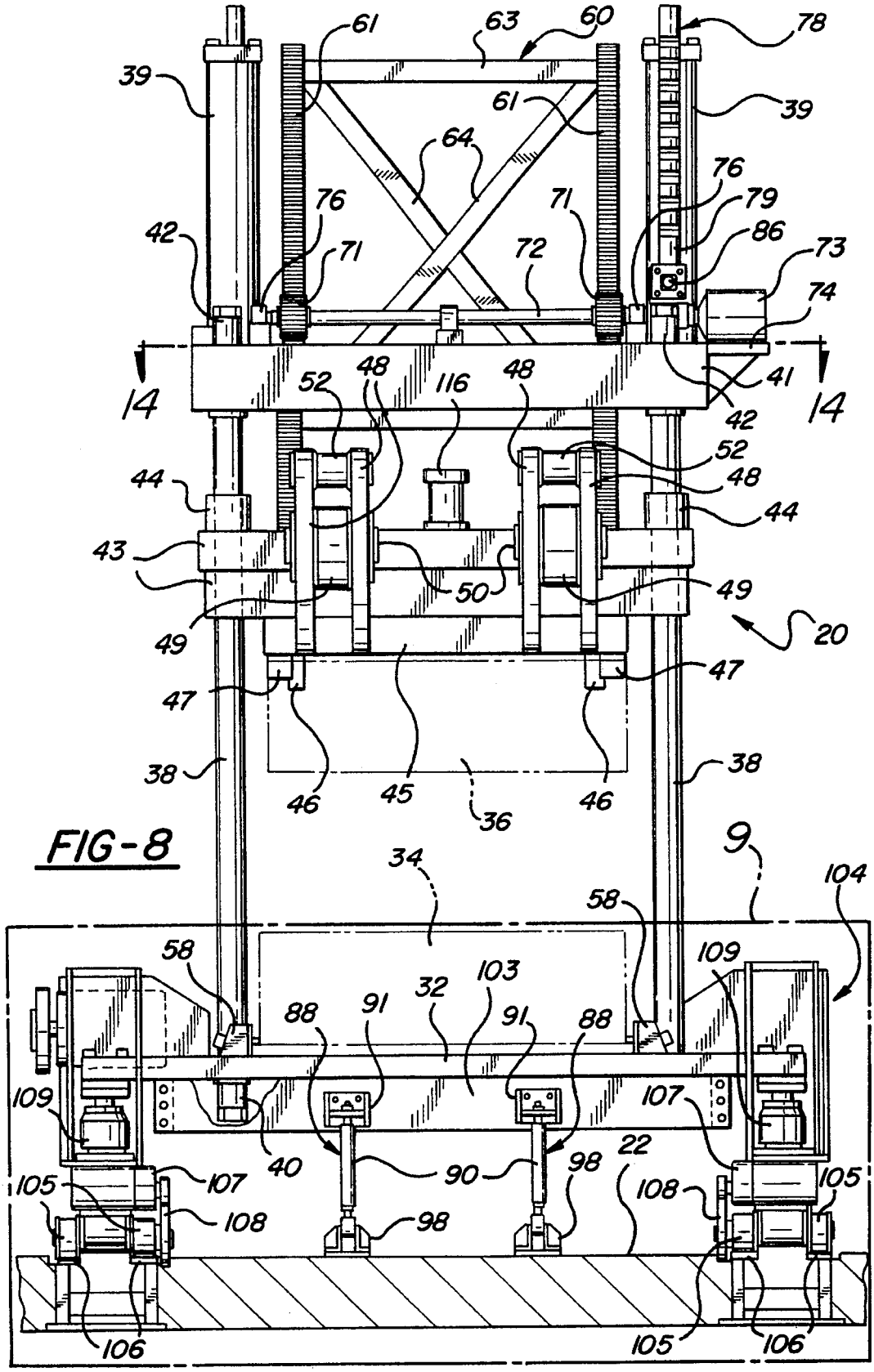
FIG. 8 is a side elevational view taken substantially along line 8—8 of FIG. 7.
Figure 9:
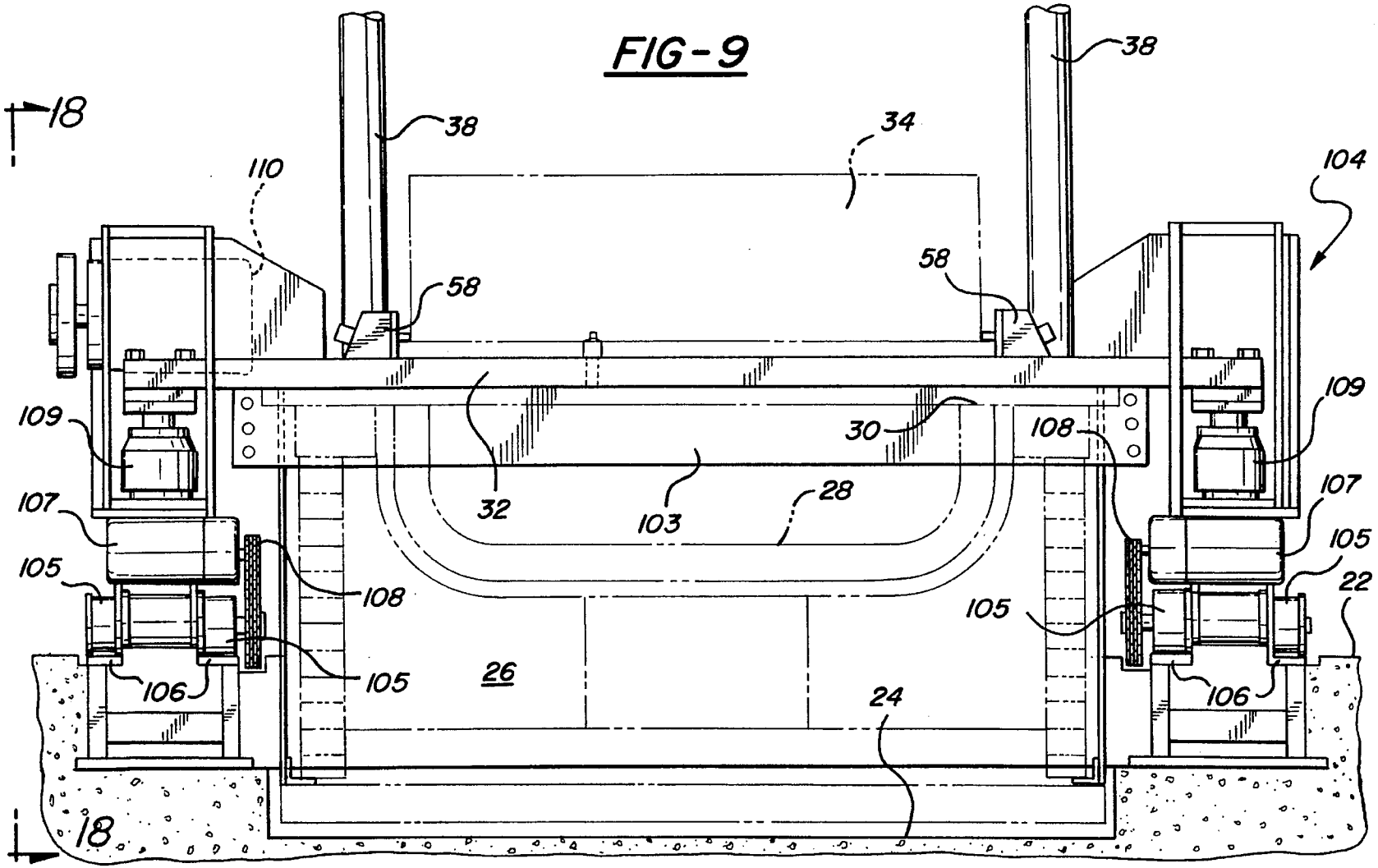
FIG. 9 is an enlarged fragmentary view partially broken away and in cross-section of the lower portion in the box shown in FIG. 8.

The apparatus comprises a casting assembly generally shown at 20 and a crucible structure 22. As shown in FIG. 8, the crucible structure 22 defines a floor with a pit 24 therein for supporting a furnace 26 and a crucible 28. The crucible 28 holds a molten metal bath and opens upwardly as defined by the periphery or rim 30.

The casting assembly 20 includes a base plate 32 for supporting the drag 34 (lower half) of a mold above the molten metal bath, the upper half of the mold being the cope 36. The cope 36 and drag 34 define a mold cavity for receiving and molding metal into a desired shape. As is well known in the art, a riser stalk extends downwardly from the drag 34 of the mold and into the molten metal bath for conveying the molten metal up and into the cavity of the mold. A vacuum is applied to the mold cavity and/or an inert gas or dry air applies a positive pressure to molten metal bath thereby forcing the molten metal to flow up through the riser stalk and into the mold cavity.

A plurality of guide posts 38, four in total, extend upwardly from the base plate 32 and define a rectangular operating area therebetween. The bottoms of the guide posts 38 are secured to the base plate 32 by collar and threaded fastener assemblies 40, as shown in FIG. 8. A fixed platen 41 is supported by the posts in fixed vertical spacing above the base plate 32. A plurality of collar and threaded fastener assemblies 42 secure the fixed platen 41 to the tops of the guide posts 38 so that the vertical distance between the base platen 32 and the fixed platen 41 is constant or fixed.

A movable platen 43 is guided for vertical movement by the guide posts 38 in the operating area by and between the guide posts 38. A bearing sleeve 44, integral with the movable platen 43, surrounds each guide post 38. A pair of ram actuators 39 interconnect the fixed platen 41 and the movable platen 43 for moving the movable platen 43 vertically on the guide posts 38.

A tilt plate 45 is operatively connected to the movable platen 43 and presents a downwardly facing attachment surface under the movable platen 43 in an operating position (as shown in FIGS. 1, 4 through 6, in solid lines in FIG. 7, and in FIG. 8) for supporting the cope 36 of the mold under the movable platen 43.

Figure 2:
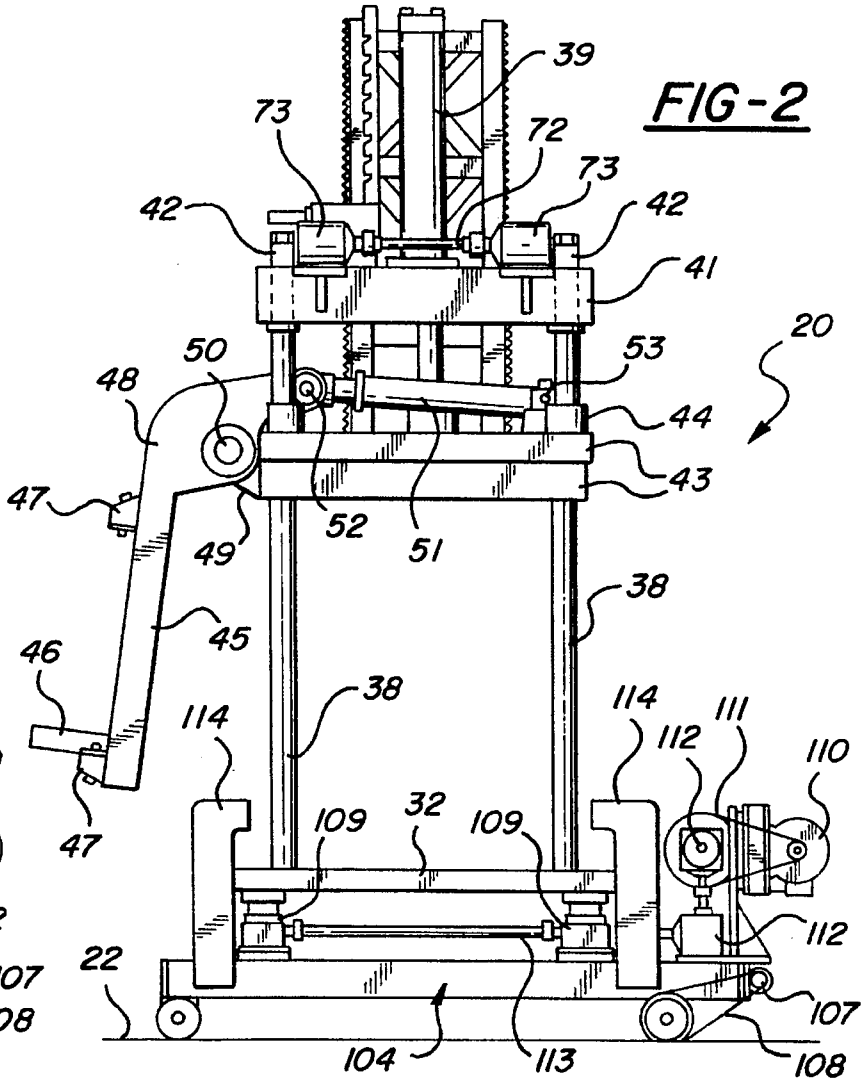
FIG. 2 is a view like the preceding view but showing the loading position.
Figure 1:
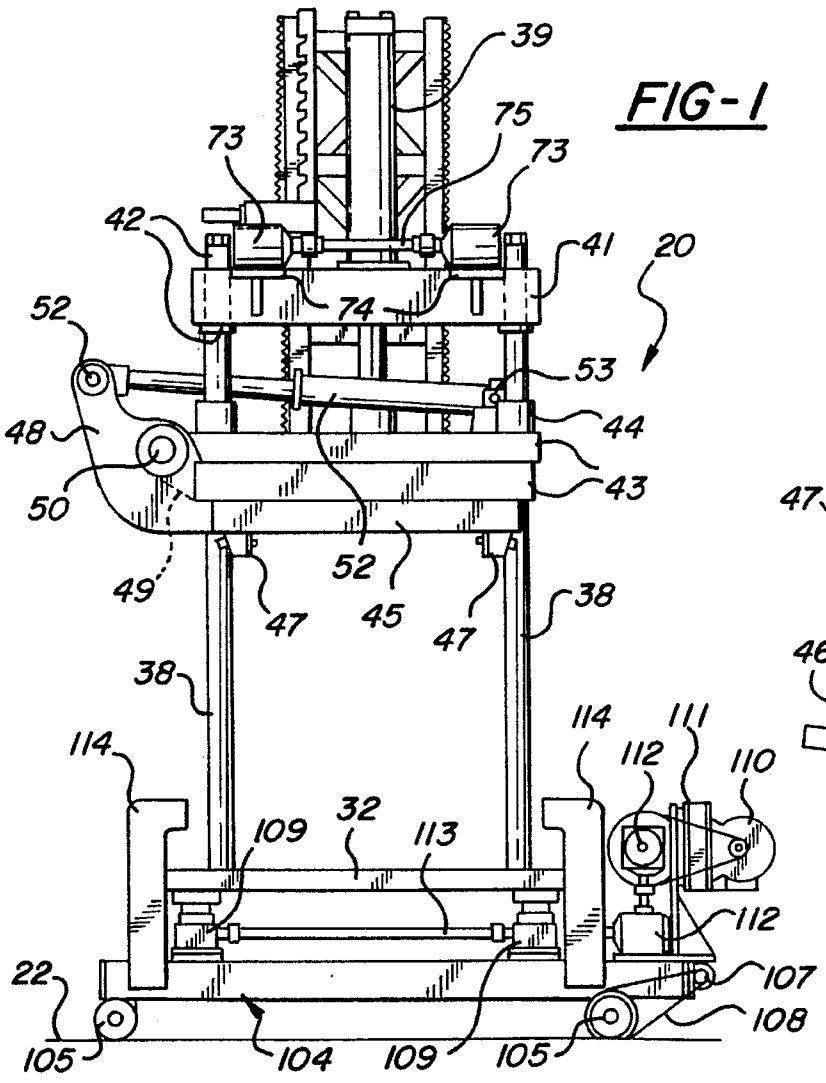
FIG. 1 is a front elevational view of a preferred embodiment in the pre-loaded position.
Figure 3:
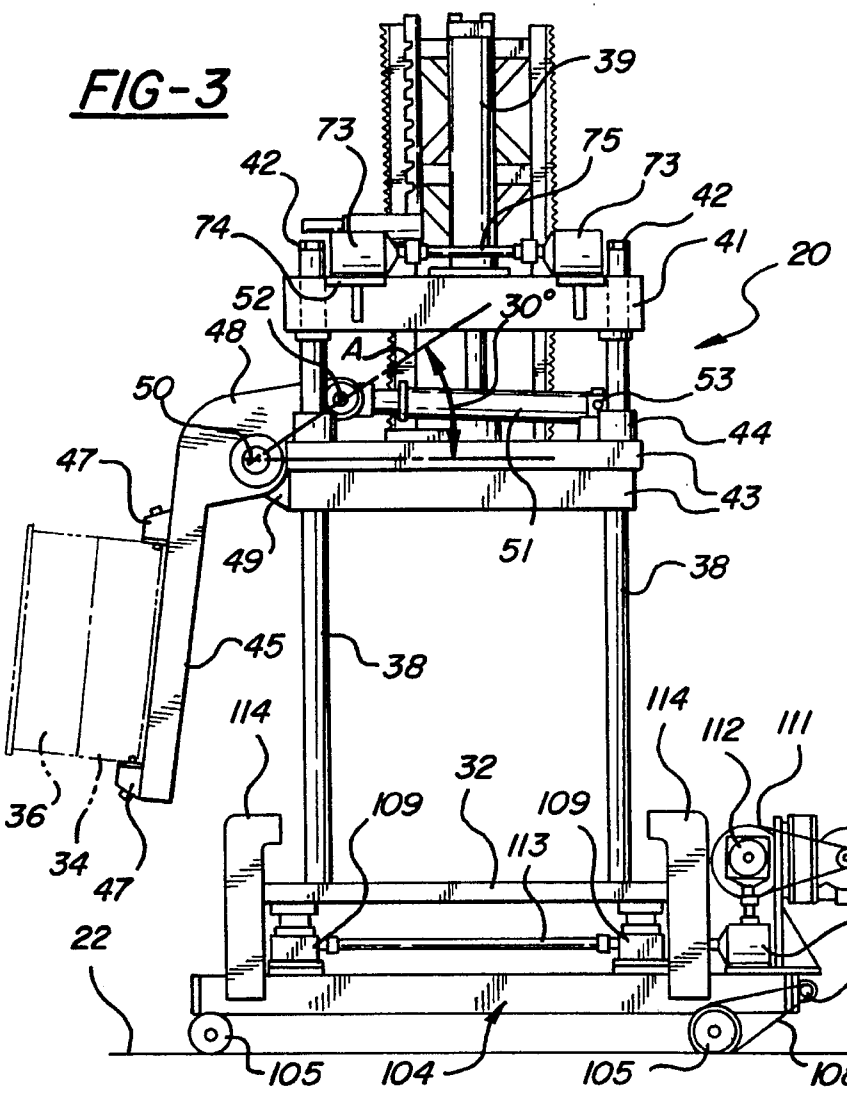
FIG. 3 is is a view like FIG. 2 but showing the mold in phantom in the loading position.
Figure 6:
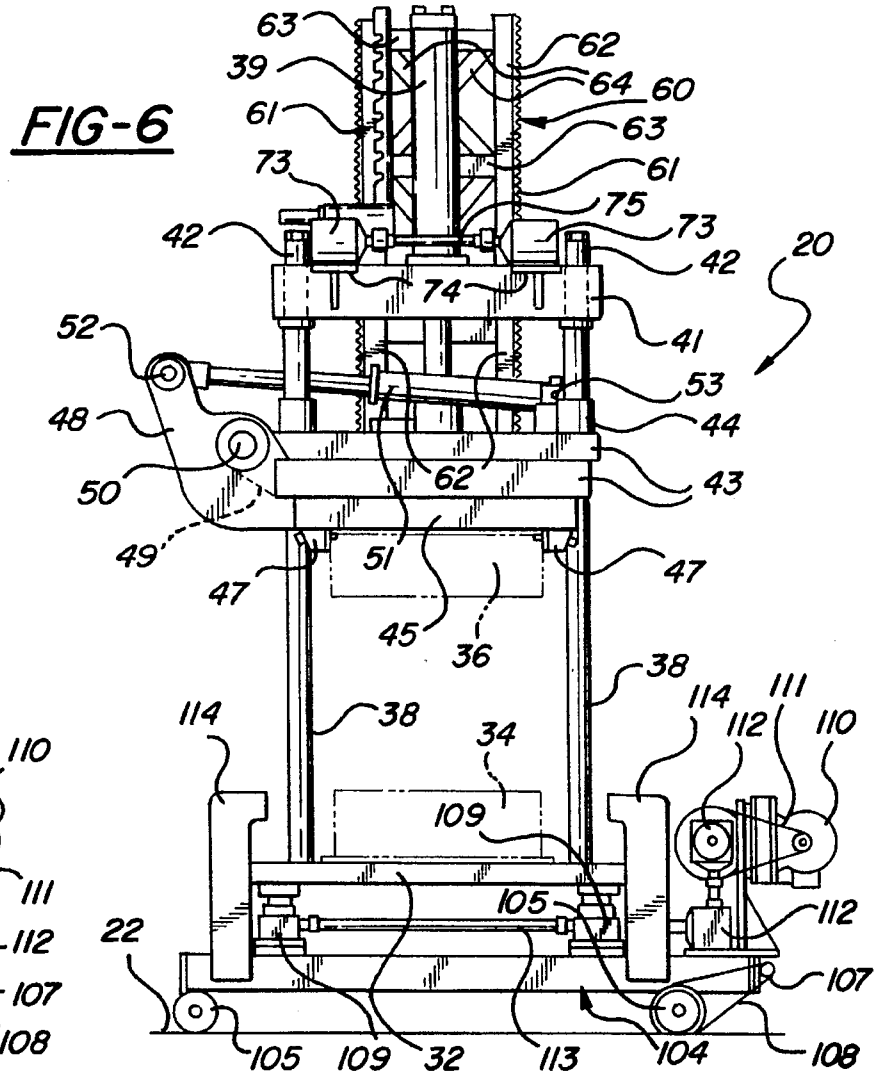
FIG. 6 is a view like the preceding views but showing the mold in phantom in the open position.
Figure 5:
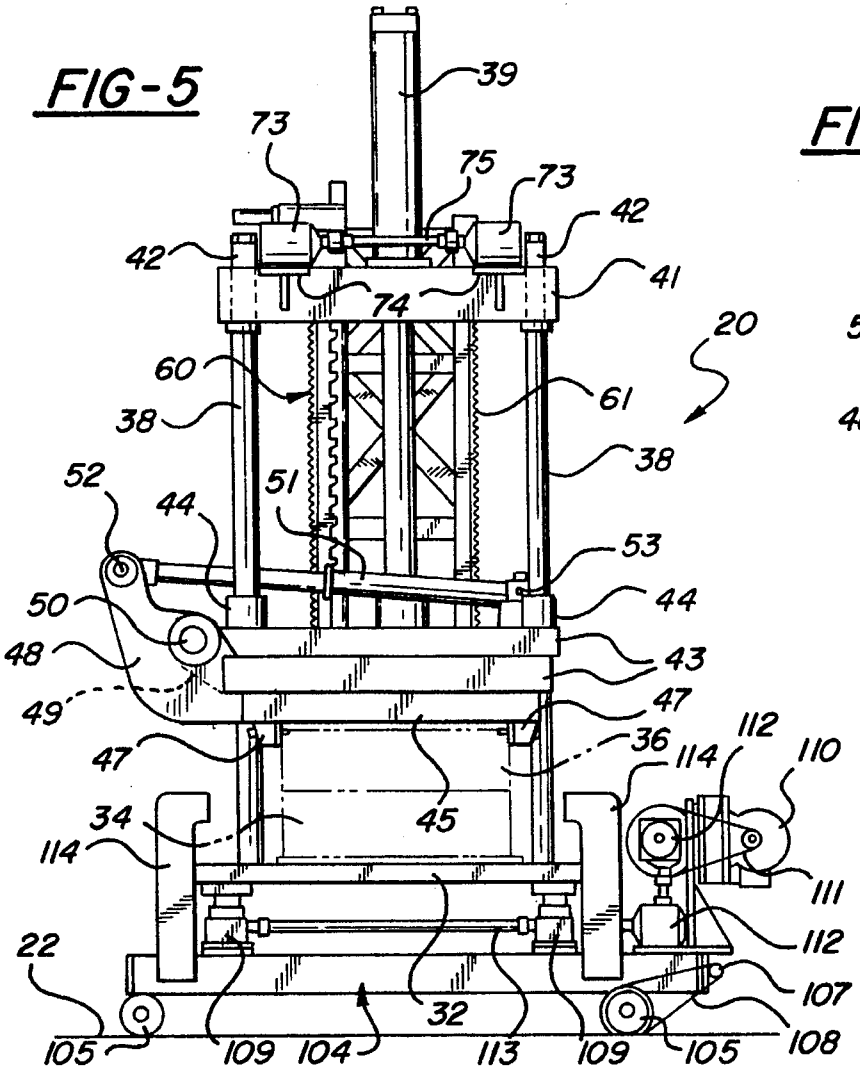
FIG. 5 is a view like the preceding views but showing the mold in phantom and in the casting position.

The apparatus is characterized by a mechanism for moving the tilt plate 45 laterally of the guide posts 38 to a loading position, as shown in FIGS. 2 and 3, outside the operating area with the attachment surface facing sufficiently upwardly to allow a cope 36 and drag 34 defining a mold to rest thereon under the force of gravity. A plurality of removable stakes 46 define a support and locating ledge extending upwardly from the attachment surface in the loading position for receiving and holding or cradling a mold on the attachment surface against the force of gravity in the loading position. A plurality of cope clamps 47 extend upwardly from the attachment surface for clamping the cope 36 to the attachment surface. When the mold is to be loaded onto the tilt plate 45, the cope 36 and drag 34 are banded together so as to be movable as a unit and so that the clamping of the cope 36 in place on the tilt plate 45 will also hold the drag thereto. Devices which may be used as cope clamps 47 are available from GS CLAMPS as model GS0630. As these clamps 47 are tightened, they remove the weight of the mold from the stakes 46 which may or may not be removed from stake holes in the tilt plate 45.

A plurality or first and second pairs of crank arms 48 are integral with or fixed to and extend laterally outwardly and upwardly from one lateral edge of the tilt plate 45 to a distal end. A pair of spaced flanges 49 extend outwardly from the movable platen 43 outside the operating area with one of the flanges 49 disposed between the first pair of crank arms 48 and with the other flange 49 disposed between the second pair of crank arms 48. A tilt axis pivot pin 50 extends between each pair of the crank arms 48 and define a tilt axis. One of the flanges 49 extends from the movable platen 43 and surrounds the pivot pin 50 extending between the first pair of crank arms 48 and the second flange extends from the movable platen 43 and surrounds the pivot pin 50 extending between the second pair of crank arms 48. The pivot pins 50 are aligned axially with one another to define a pivotal joint on a tilt axis between the movable platen 43 and the tilt plate 45 for rotating the crank arms 48 and the tilt plate 45 as a unit relative to the movable platen 43 about that tilt axis defined by the pivot pins 50.

Figure 4:
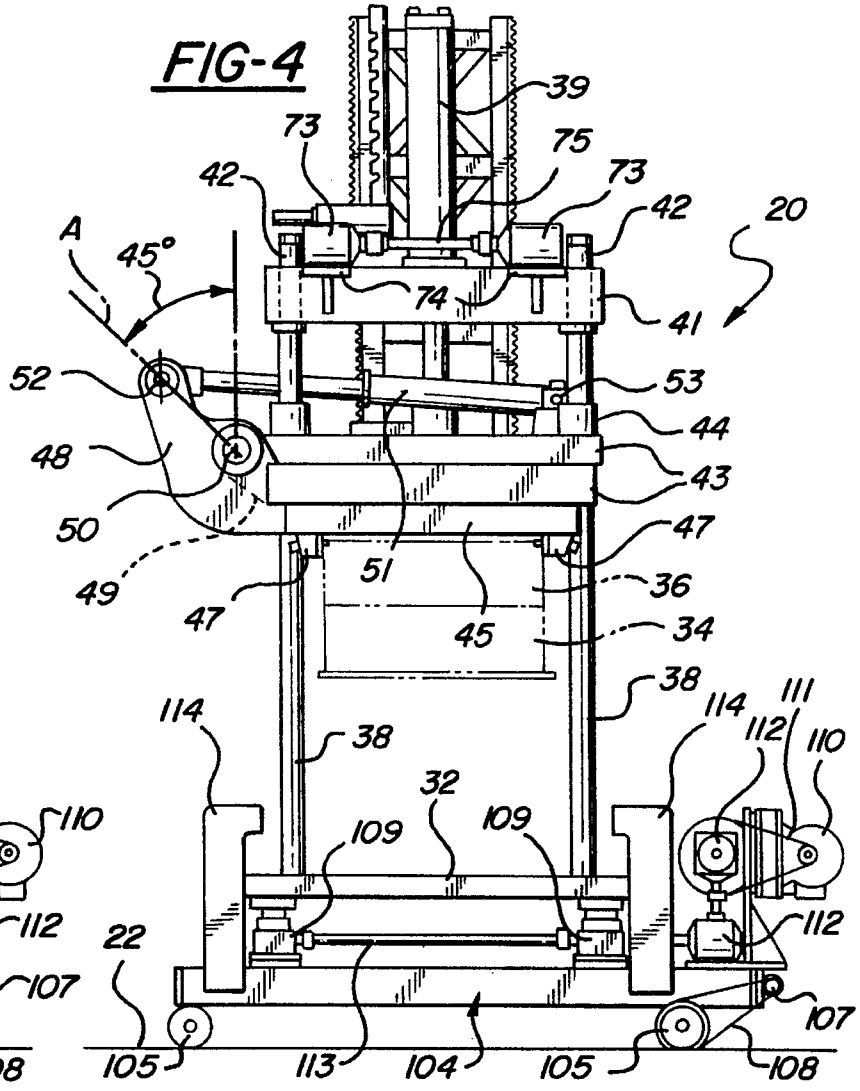
FIG. 4 is a view like the preceding views but showing the entire mold in phantom in an interim loading position.
Figure 10:
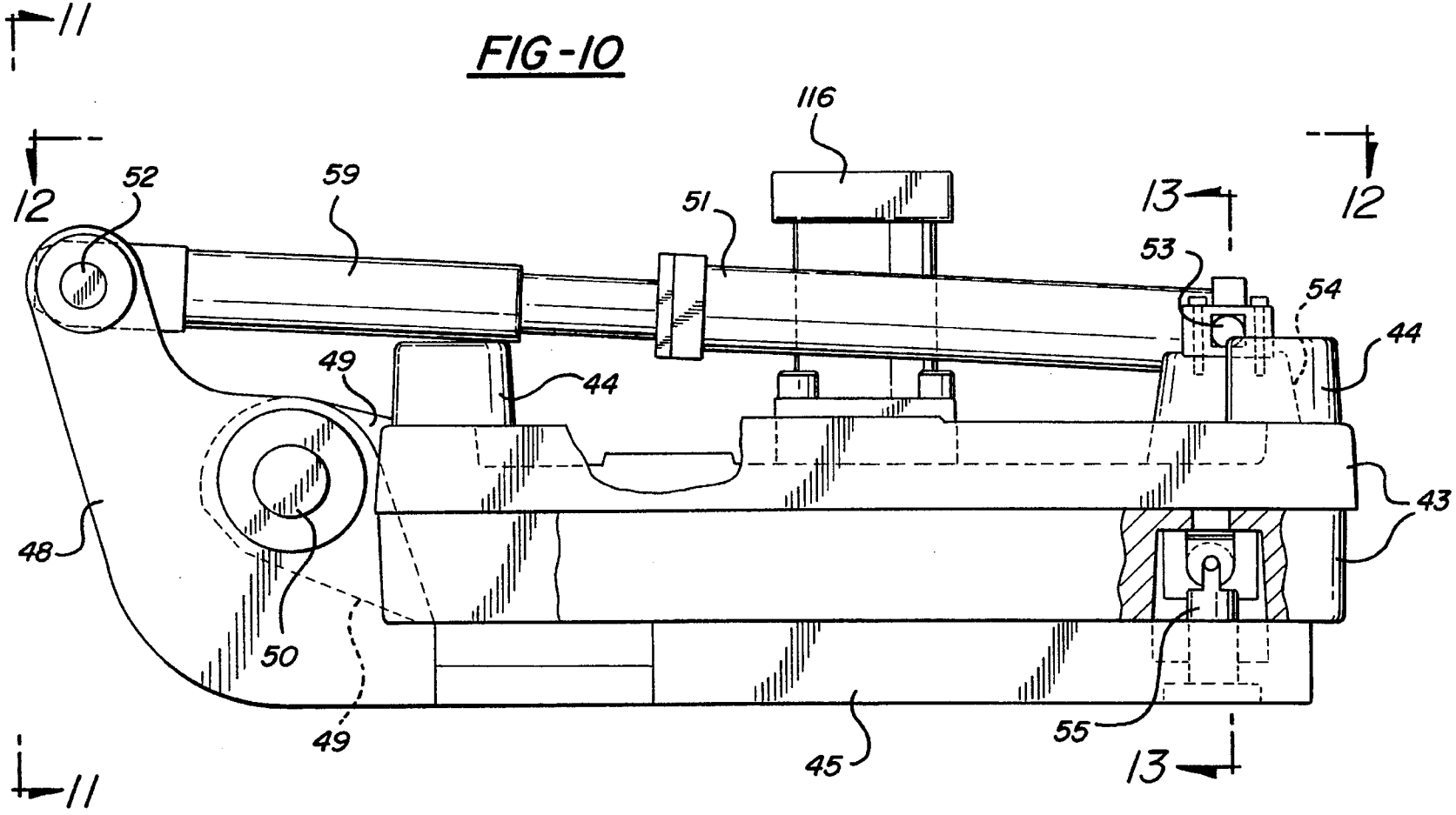
FIG. 10 is a side elevational view, partially broken away and in cross-section, of a preferred embodiment of the tilt mechanism.
Figure 11:
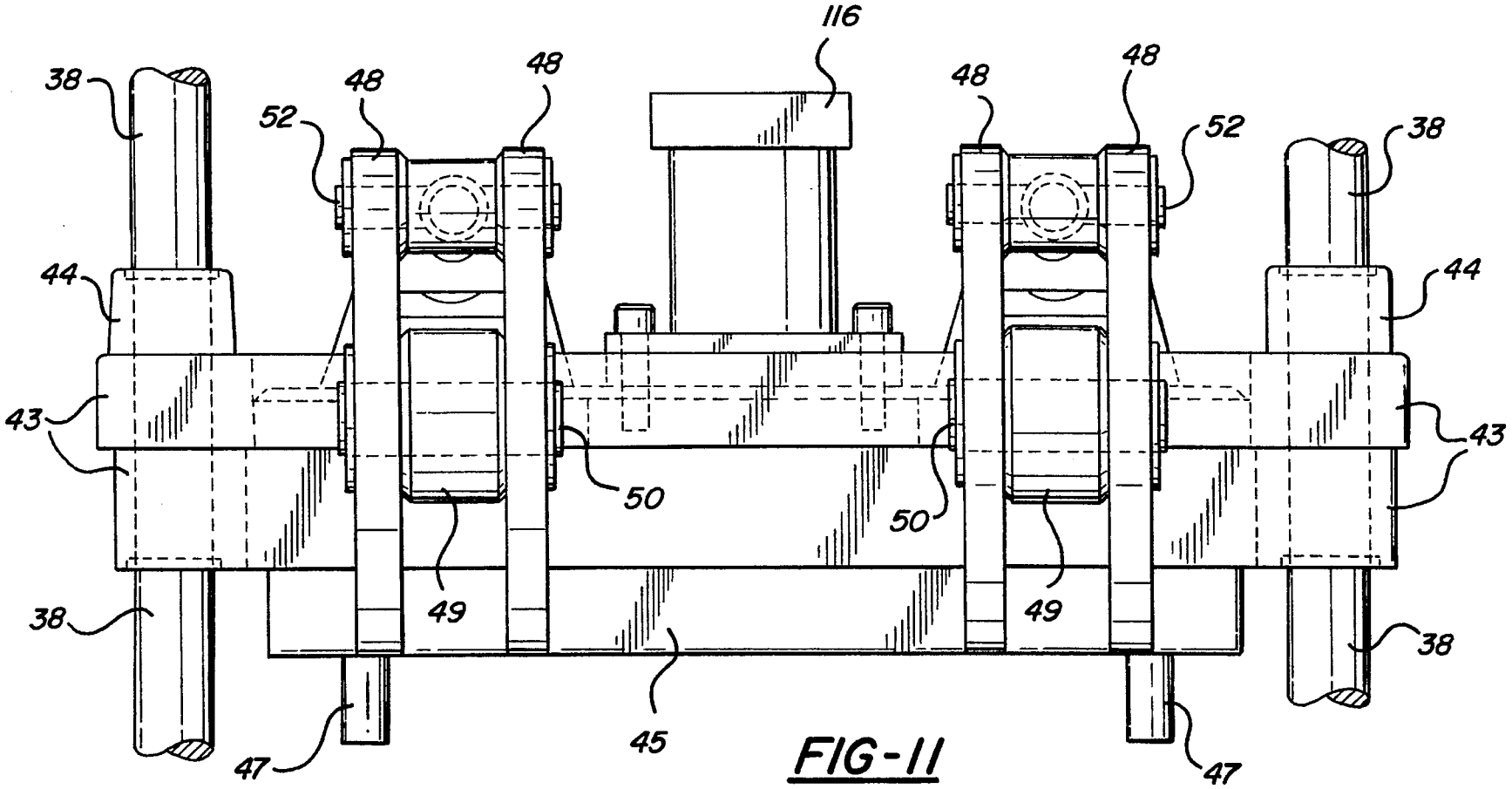
FIG. 11 is a side view of the tilt mechanism taken substantially along line 11—11 of FIG. 10.

In order to accomplish this rotary or pivotal movement, the mechanism includes a pair of hydraulic cylinders 51 disposed above the movable platen 43. Each hydraulic cylinder 51 has a first connection 52 to the distal ends of one pair of the crank arms 48 and a second connection 53 to the movable platen 43 for rotating the crank arms 48 to thereby rotate the tilt plate 45 about the tilt axis of the pivot pins 50 between the operating position and the loading position. The first connection 52 of the piston rod of each cylinder 51 comprises a pin extending between the distal ends of the crank arms 48 and a clevis attached to the piston rod. The second connection 53 of the base of each cylinder 51 comprise a trunnion with blocks bolted to a saddle 54 as shown in FIGS. 10 and 11. The hydraulic cylinders each define an actuation axis extending between the first connection 52 to the distal end of the crank arms 48 and the second connection 53 to the movable platen 43. The crank arms define a crank arm axis A, as shown in FIGS. 3 and 4, which extends between the first connection 52 to the hydraulic cylinders 51 and the tilt axis of the pivot pins 50. The tilt axis 50 is disposed laterally outside of the operating area defined by the guide posts 38 and vertically above the tilt plate 45. In addition, the first connection 52 is disposed laterally outwardly from the tilt axis 50 in the operating position, as illustrated in FIG. 4. On the other hand, the second connection 53 is disposed inwardly of the guide posts 38 and above the movable platen 43 and in the operating area when in the loading position. As illustrated in FIGS. 3 and 4, the tilt plate 45 rotates through an angle of more than 90° from the operating position to the loading position and, more specifically, the tilt plate 45 rotates through an angle of 105°. The angle between the crank arm axis A and the actuation axis of the hydraulic cylinders is less than 90° in the operating position; the crank arm axis A is disposed at an angle of 45° relative to vertical when in the operating position, as shown in FIG. 4. The angle between the crank arm axis A and the actuation axis of the hydraulic cylinder is less than 180° in the loading position; it is 30° less, or 150°, as illustrated in FIG. 3. Accordingly, the tilt plate 45 moves through an angle of 105° between the operating position and the loading position.

Figure 13:
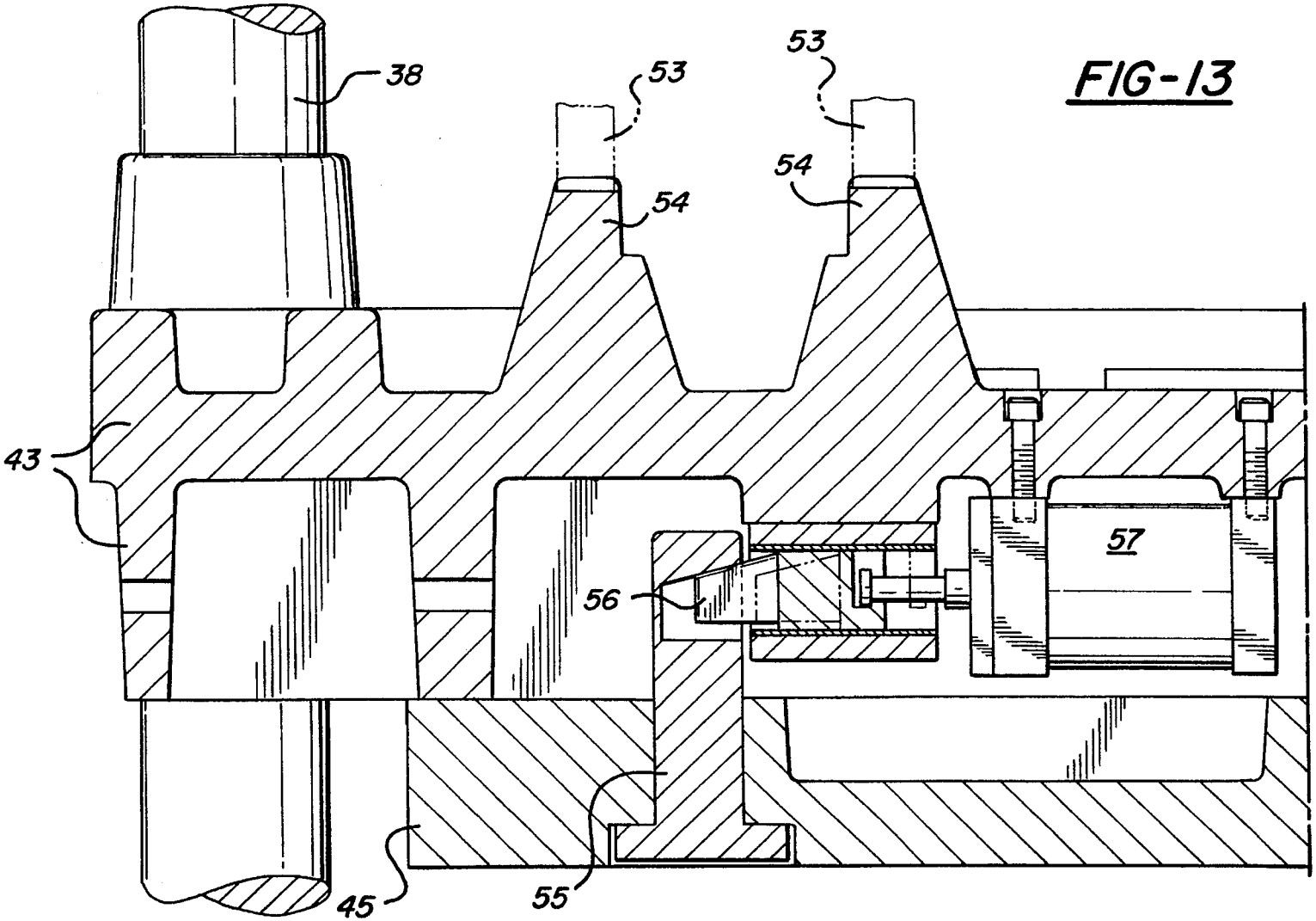
FIG. 13 is a cross-sectional view taken substantially along line 13—13 of FIG. 10.

As stated above, the cope clamps 47 hold the entire mold, cope 36 and drag 34, to the tilt plate 45 as the mold is rotated from the loading position of FIG. 3 to the interim position of FIG. 4. When in the interim loading position of FIG. 4, support locks 55, shown in FIGS. 10 and 11, lock the tilt plate 45 to the movable platen 43 in the operating position. The locks 55 extend upwardly from the tilt plate 45 and present cam wedge surfaces which are engaged by wedge locks 56, which, in turn, driven by actuators 57. Once the wedge locks 56 are driven into the locks 55 to hold the tilt plate 45 tight against the movable platen 43, as shown in FIG. 13, the ram actuators 39 move the movable platen 43 vertically downward to rest the drag 34 of the mold onto the base plate 32. A plurality of drag clamps 58, like the cope clamps 47 and shown in FIGS. 8 and 9, extend from the base plate 32 for clamping the drag 34 to the base plate 32. Once the drag clamps 58 secure the drag to the base plate 32, the bands holding the cope 36 and drag 34 together are removed so that the mold may be opened upon retraction of the ram actuators 39.

Figure 7:
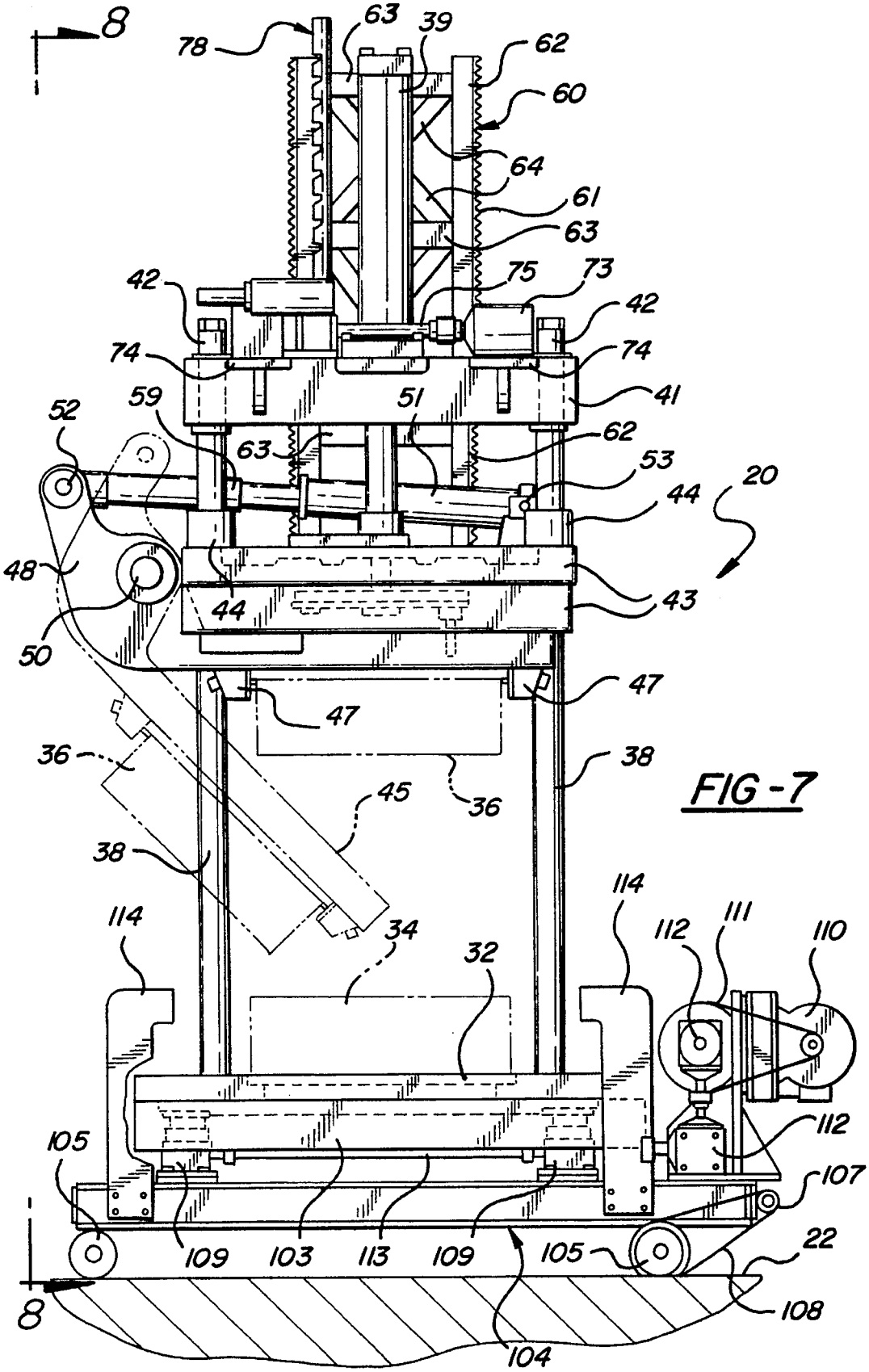
FIG. 7 is a view like the preceding views but showing the mold in phantom and in the cleaning position.

During operation it is frequently desirable to clean the interior of the mold and therefore the tilt plate 45 is rotated to an intermediate cleaning position, as shown in FIG. 7. A safety lock 59, shown in FIGS. 7 and 10, is included for mechanically limiting the contraction of the hydraulic cylinders 51 to limit the rotation of the tilt plate 45 from the operating position to a cleaning position remaining within the guide posts 38 and below the movable platen 43. In other words, the safety lock 59 surrounds the piston rod of the hydraulic cylinders 51 to prevent the tilt plate 45 and, therefore the cope 36, from swinging past the cleaning position and out of the assembly.

Figure 12:
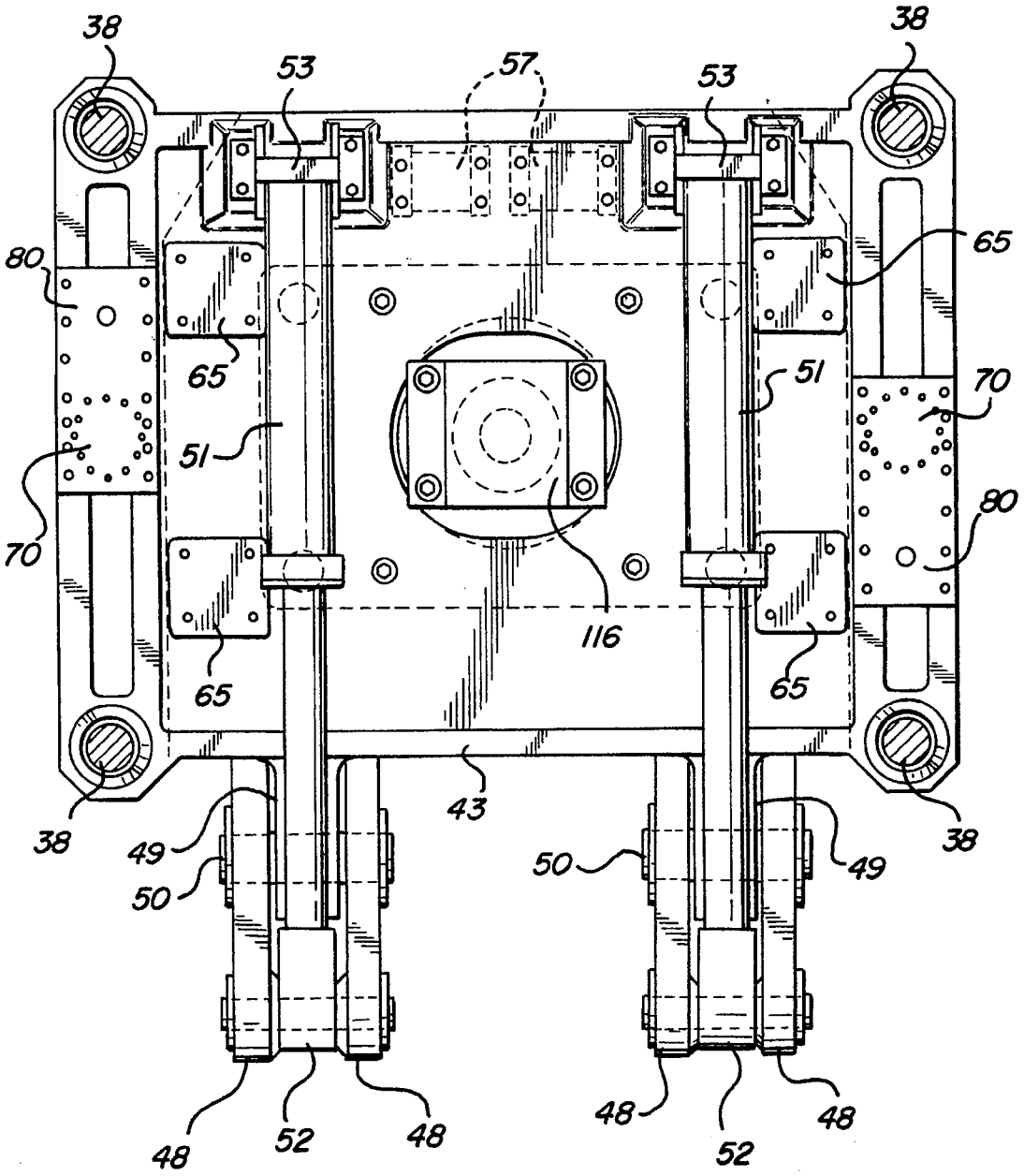
FIG. 12 is a plan view of the tilt mechanism taken substantially along line 12—12 of FIG. 10.

The apparatus is further characterized by a rack mechanism generally indicated at 60 and interconnecting the fixed platen 41 and the movable platen 43 for preventing the movable platen 43, and therefore the cope 36, from cocking relative to the posts 38 during vertical movement thereof. The rack mechanism 60 includes a gear rack 61 paired with each of the posts 38 with the bottom end of each gear rack 61 secured to the movable platen 43. A framework interconnects the gear racks 61 and comprises a box-like structure with one of the gear racks 61 at each vertical comer of the framework. The framework includes a vertical stringer or beam 62 at each of the corners with cross-beams 63 interconnecting the stringers 62. Triangular trusses 64 extend between the stringers 62 at the corners for providing rigidity and strength, as in the span of a bridge. The bottom ends of the stringers 62 are secured to pads 65 presented by the movable platen 43, as shown in FIG. 12. The gear racks 61 are, therefore, secured to the movable platen 43 by being secured to the stringers 62.

Figure 14:
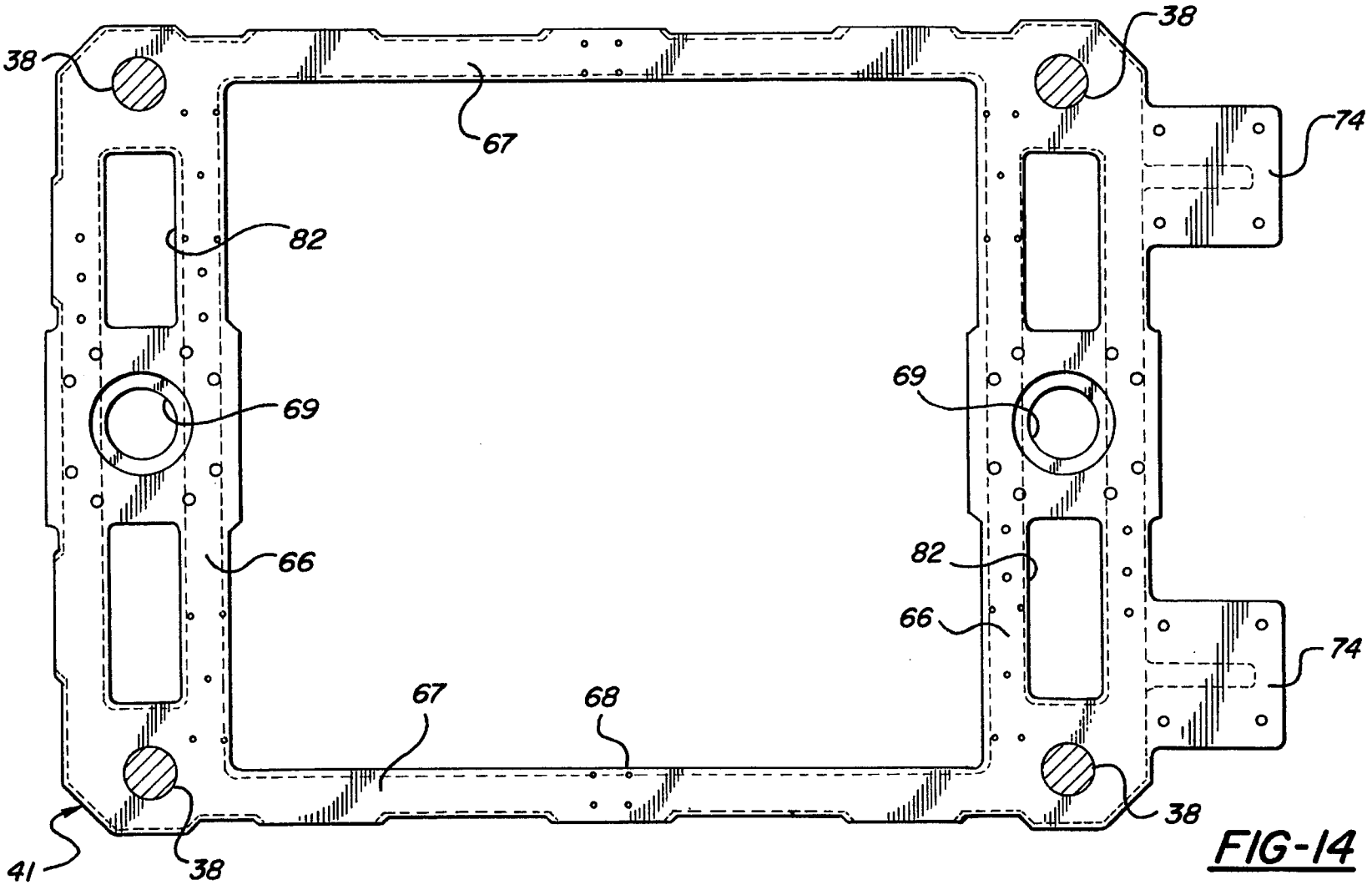
FIG. 14 is a plan view of the fixed platen taken substantially along line 14—14 of FIG. 7.

As illustrated in FIG. 14, the fixed platen 41 comprises a platform 66 along each of opposite sides with cross members of beams 67 interconnecting the platforms 66 to define a centrally disposed opening 68. The framework 60 is disposed within the opening 68. Each of the ram actuators 39 includes a ram cylinder disposed midway of each of the platforms 66 and extending upwardly therefrom; the platforms 66 having a hole 69 therein below each of the ram cylinders 39. A piston rod extends downwardly from each ram cylinder 39 and through the hole 69 therebeneath and is connected at its lower end to a plate 70 secured to the the movable platen 43.

As shown in FIGS. 8 and 16, a spur gear 71 is in meshing engagement with each of the gear racks 61. Each spur gear 71 is supported on the fixed platen 41 by a synchronizing drive system for simultaneously rotating the four spur gears 71 in unison. The synchronizing drive system includes parallel shafts 72 on opposite sides of the framework 60 with two of the spur gears 71 supported on each of the shafts 72 and in meshing engagement with two of the gear racks 61. A pair of 90° gear boxes 73 are supported on ledges 74 extending from the fixed platen 41. The gear boxes 73 are coupled together by cross-shaft 75 and are respectively coupled to the parallel shafts 72 for rotating the shafts 72 and all of the spur gears 71 in unison. A pillow block 76 supports the shafts 72 adjacent each of the spur gears 71 for rectilinearly moving each spur gear 71 into and out of meshing engagement with its associated gear rack 61 to adjust the running tolerances therebetween. Each pillow block 76 includes a cradle accurately or precisely located and fixed or secured to the fixed platen 41 with a movable bearing block rotatably supporting the shaft 72 and adjustably attached to the cradle, i.e., the pillow block is adjusted inside of the cradle by jack screws then locked down by lock screws. The middle pillow block 76 floats as the two outer ones are adjusted and is thereafter tightened. In the alternative, the center or middle pillow block 76 may be a simple bearing block secured in place after the adjustment of the two outer pillow blocks 76. A keyless bushing 77 supports each spur gear 71 on its shaft 72 for allowing free rotation of each spur gear 71 during setup and to thereafter lock each spur gear 71 to its shaft 72. The keyless bushing 77 is like an adjustable collet which expands to lock the spur gear 71 to the shaft 72. Therefore, the shafts 72 may be adjusted into tight running engagement with the respective racks 61 and thereafter tightened into close gear running tolerance, then the key bushings tightened to synchronize the spur gears 71. Since the framework 60 is a rigid structure, and the spur gears move the stringers in tight tolerance movement, the cope is prevented from cocking and is thereby removed from the molded part without sticking or damaging the molded part. Said another way, the framework 60 and synchronizing drive system assure that lifting forces are evenly distributed across the lateral extent of the cope 36.

Figure 17:
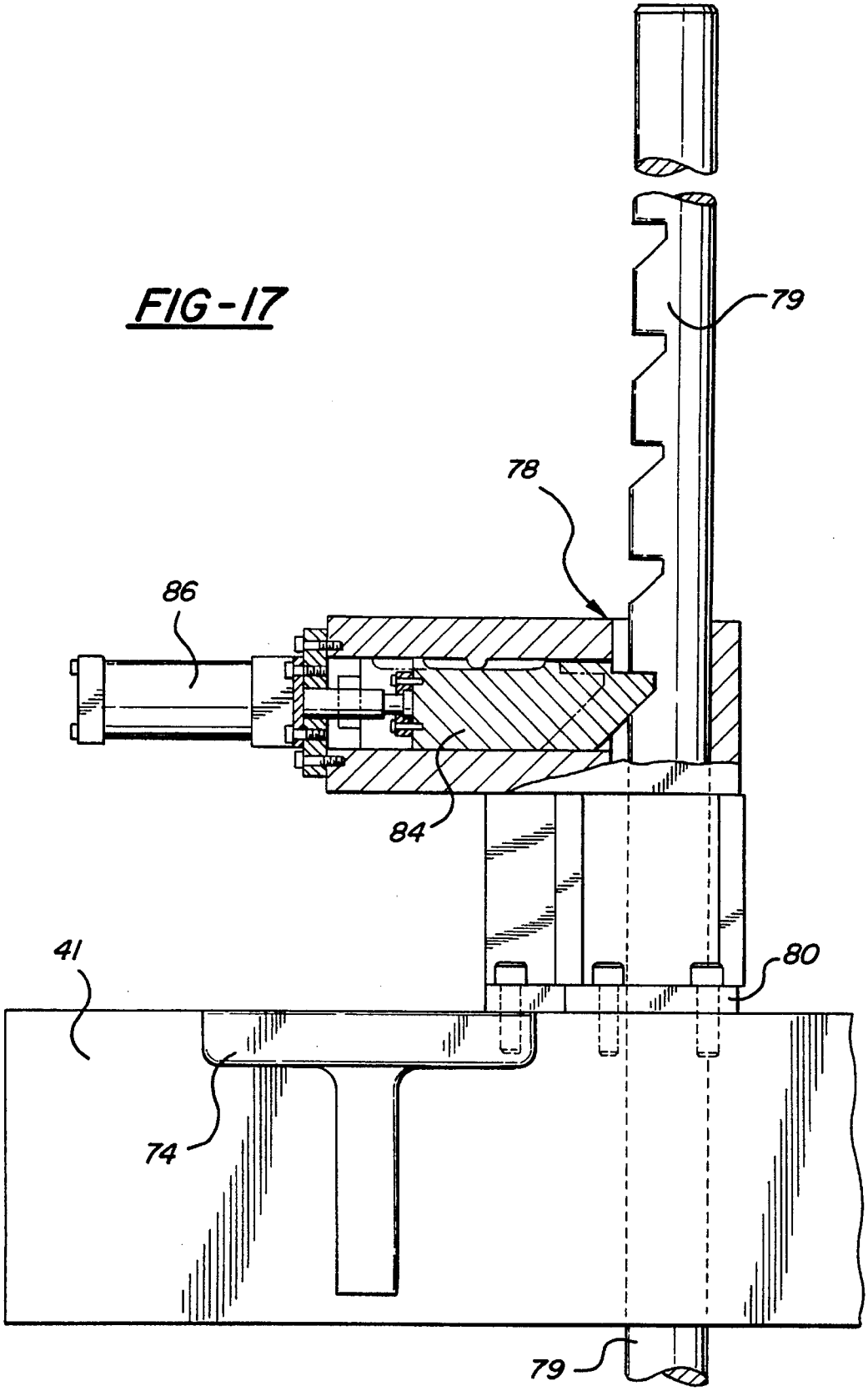
FIG. 17 is fragmentary view, partially broken away and in cross-section, of the safety catch assembly.
Figure 18:
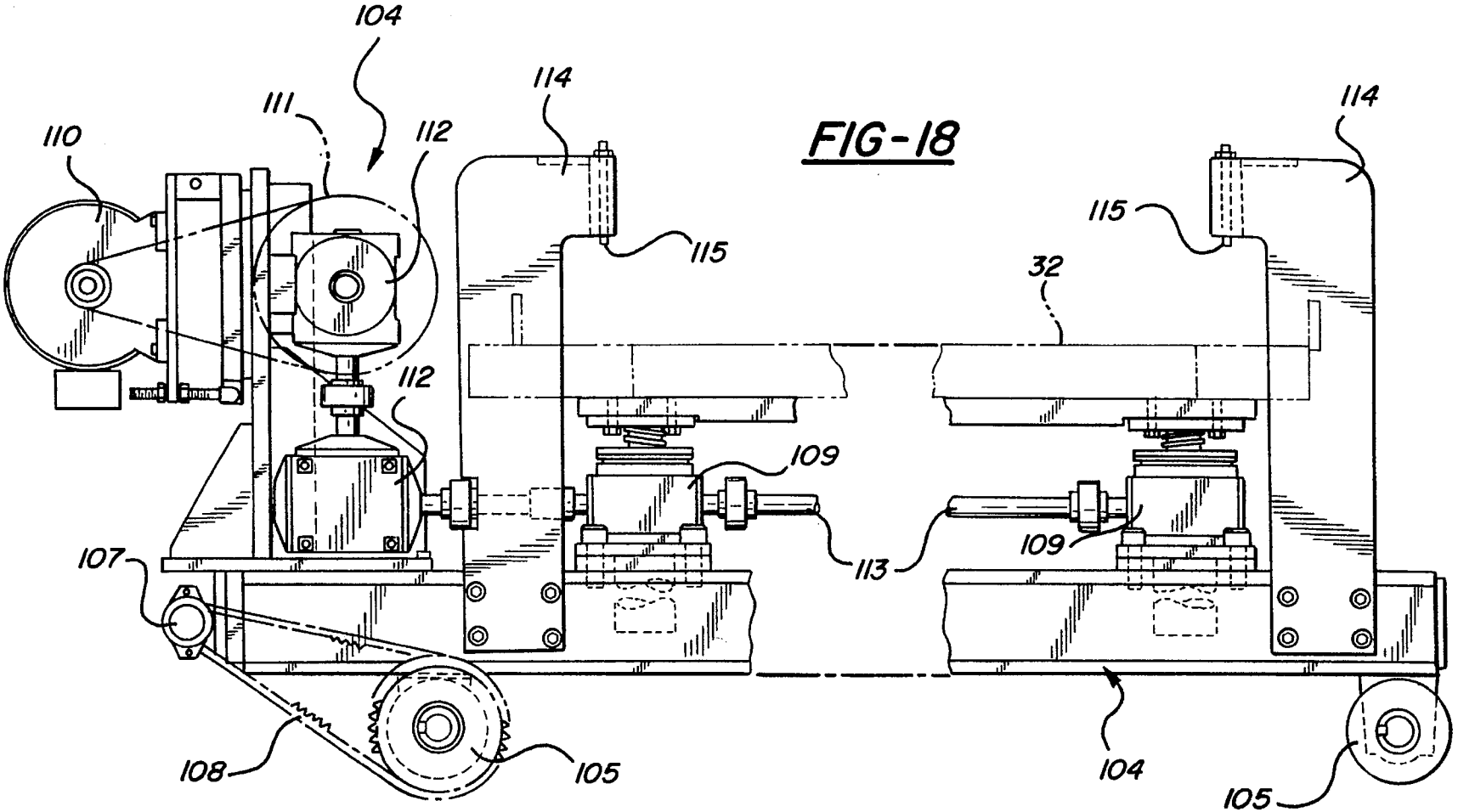
FIG. 18 is an elevational view of the carriage assembly taken substantially along line 18—18 of FIG. 9.
Figure 19:
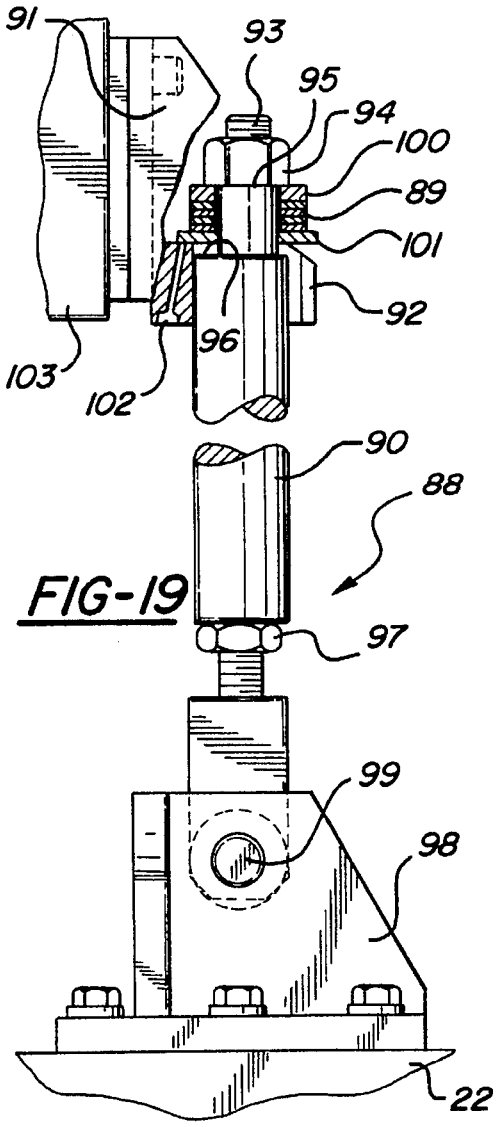
FIG. 19 is a side elevational view, partially broken away and in cross-section of the hold-down mechanism.
Figure 20:
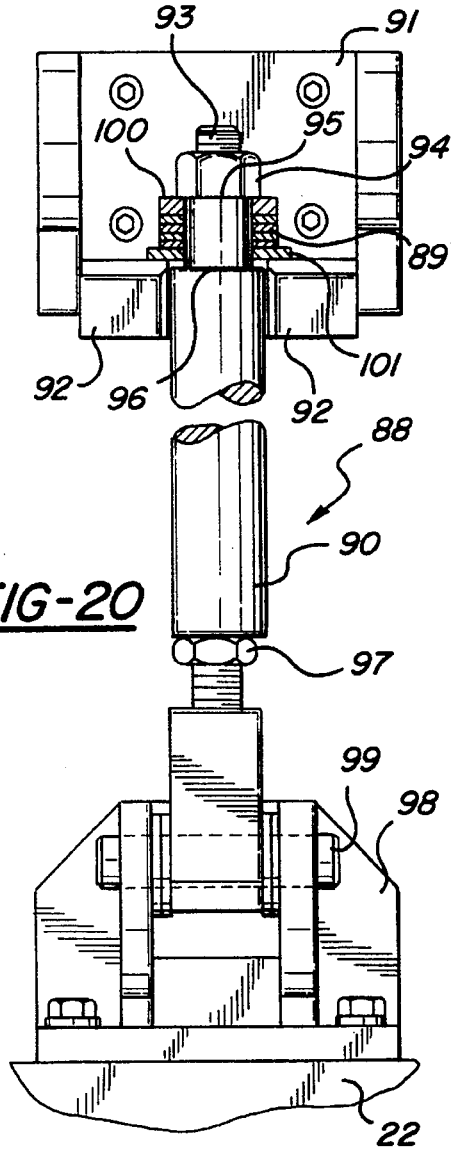
FIG. 20 is a front view of the mechanism of FIG. 19.
Figure 21:
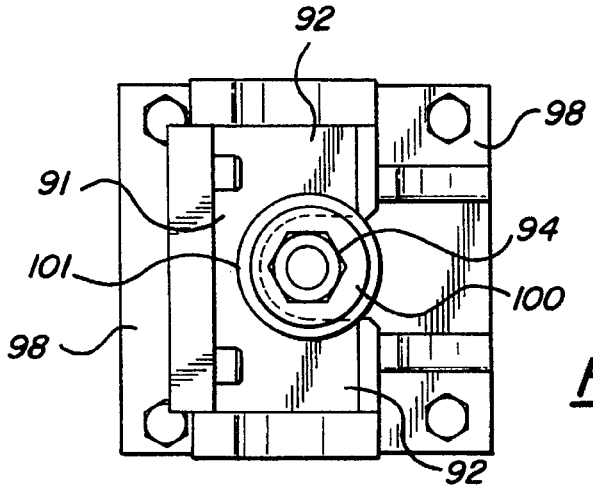
FIG. 21 is a top view of FIG. 19.

A safety catch assembly, generally indicated at 78 and most extensively in FIG. 17, interconnects the movable platen 43 and the fixed platen 41 for automatically catching the movable platen 43 in the event of failure of the ram actuators 39. The safety catch assembly 78 includes a ratchet bar 79 connected to and extending upwardly from the pad portion 80 on movable platen adjacent each of the cylinders and upwardly through holes 82 in each of the platforms 66. A ratchet pawl 84 is associated with each ratchet bar 79. A spring biased actuator 86 is associated with each pawl 84 for biasing the pawl 84 into engagement with the ratchet bar 79. The pawl actuator 86 associated with each pawl 84 normally holds the pawl 84 out of engagement with the associated ratchet bar 79 under air pressure against the force of the internal spring whereby the pawl 84 moves into locking engagement with the ratchet bar 79 under the force of the spring in the event of failure of the ram actuator 39.

The apparatus is further characterized by a hold-down mechanism 88 (as shown in FIGS. 8, and 19–21) for holding the base plate 32 in engagement with the rim 30 of the crucible 28. The hold-down mechanism 88 includes force transmitting means for maintaining a predetermined force holding the base plate 32 in engagement with the rim 30 of the crucible 28 while simultaneously allowing relative movement therebetween. More specifically, the force transmitting means comprises a plurality of Belleville-type washers 89, a plurality of tension rods 90, and a plurality of forks 91, each having a pair of spaced fingers 92. Each of the rods 90 is paired with one of the forks 91 at a threaded end 93.

The plurality of the Belleville-type washers 89 are disposed about the threaded end 93 of each rod 90. A threaded nut 94 threadedly engages the threads of each of the rods 90 for compressing the washers 89 against the fingers 92 of the forks 91. Each the rod 90 presents a nut shoulder 95 at the bottom of the threads 93 for limiting the axial movement of the nuts 94 onto the rods 90 to limit the compression of the washers 89 for maintaining the predetermined force holding the base plate 32 in engagement with the crucible 28 while allowing the relative movement between the base plate 32 and the crucible 28. Each of the rods 90 also presents a washer shoulder 96 spaced axially downwardly from the nut shoulder 95 and below the washers 89 when in engagement with the fingers 92 of the fork 91 for maintaining the washers 89 operably near the nut shoulder 95. In this manner, the washers are always near the operative end of the rods 90 for easy manual placement on the fingers 92. A turnbuckle 97 is included for adjusting the length of the rods 90. A bottom bracket 98 is secured by bolts to the crucible structure 22 for each of the rods 90 and each rod 90 is pivotally connected to its associated bottom bracket 98 by a pin 99 for swinging movement to and from engagement with its paired fork 91.

A nut washer 100 is disposed at the top of the Belleville washers 89 and below the nut 94 and a fork washer 101 is disposed at the bottom of the Belleville washers 89. The fork washer 101 has a greater dimension, i.e., diameter, than the distance between the fingers 92 of the fork 91 for engaging the top of the fingers 92 of the fork 91.

A sensing means senses the fork washers 101 being clamped tightly against the fingers 92 of the fork 91 and comprises an air passage 102 (shown in FIG. 19) extending through one of the fingers 92 of each of the forks 91 to an opening under the fork washer 101 whereby the fork washers 101 prevent the movement of air through the passages 102 in the hold-down positions. The passages 102 are connected by pneumatic tubing to a control system which prevents sequencing of the system unless all of the passages restrict the flow of air therethrough.

The base plate 32 includes a plate and strengthening ribs 103 extending from the plate to resist warping of the base plate 32. One of the strengthening ribs 103 extends along each of two opposite sides of the base plate 32 and the finger brackets 91 of the hold-down mechanisms 88 are attached to the strengthening ribs 103 along those opposite sides. More particularly, the strengthening ribs 103 extend about the entire periphery of the base plate 32 to define a four-sided and continuous strengthening rib. Each of the hold-down means 88 is movable between a hold-down position (FIGS. 19 and 20) and a released position (not shown) allowing free movement of the base plate 32 relative to the crucible 28. Alternatively, the hold-down mechanisms 88 may be attached directly to the base plate 104 on the sides of the machine between the lifting jacks 109.

A pressure differential means establishes a positive pressure of up to two, and possibly three, atmospheres between the crucible 28 and the base plate 32. This pressure is sufficient to lift the casting assembly 20 completely off the crucible 28. As alluded to above this pressure differential is accomplished by a combination of a vacuum applied to the cavity in the mold and/or an inert gas or dry air under pressure subjected to the top of the molten metal in the crucible 28.

A carriage, generally indicated at 104, is included for supporting and moving the casting assembly 20 laterally away from the crucible 28. The carriage 104 includes a plurality of wheels 105 for rolling over rails 106 supported in the crucible structure 22. A wheel drive drives the wheels 105 to move the carriage 104 along the rails 106. The wheel drive includes the hydraulic motors 107 which drive the wheels through the entrained chain loops 108.

A lift means lifts the carriage 104 into free space to thereby support the entire weight of the casting assembly 20 upon the crucible 28. The lift means also lifts the casting assembly 20 off of the crucible 28 and onto the wheels 105 for lateral movement away from the crucible 28. The lift means comprises a plurality of screw jacks 109 interconnecting the base plate 32 and the carriage 104. A lift drive means rotates the screw jacks 109 and includes the electric motor 110, the loop drive 111, the 90° gear boxes 112, and the synchronizing shafts 113 to drive the jacks 109 in unison. Four L-arms each presenting a downwardly projecting stop 115 are attached to the beam structure of the carriage and extend upwardly for limiting the upward movement of the casting assembly on the carriage and to rigidly hold the carriage 104 and the casting assembly 20 together as a unit.

The assembly 20 also includes a knock-out cylinder 116 for actuating a part knock out pins into the mold cavity in the cope 36.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A low-pressure casting apparatus for conveying molten metal upwardly from a molten metal bath to a mold thereabove, said apparatus comprising:

a base plate (32) for supporting a drag (34) of a mold above the molten metal bath;

a plurality of guide posts (38) extending upwardly from said base plate (32) and defining an operating area therebetween;

a fixed platen (41) supported by said posts (38) in fixed vertical spacing above said base plate (32);

a movable platen (43) guided for vertical movement in said operating area defined by and between said guide posts (38);

a ram actuator (39) interconnecting said fixed platen (41) and said movable platen (43) for moving said movable platen (43) vertically on said guide posts (38);

a tilt plate (45) operatively connected to said movable platen (43) and presenting a downwardly facing attachment surface under said movable platen (43) in an operating position for supporting the cope (36) of the mold under said movable platen;

said apparatus characterized by a mechanism for moving said tilt plate (45) laterally of said guide posts (38) to a loading position outside said operating area with said attachment surface facing sufficiently upwardly to allow the cope (36) and drag (34) defining the mold to rest thereon under the force of gravity.

2. An apparatus as set forth in claim 1 including a support ledge (46) extending upwardly from said attachment surface in said loading position for receiving and cradling the mold on said attachment surface against the force of gravity in the loading position.

3. An apparatus as set forth in claim 2 including at least one crank arm (48) fixed to and extending upwardly from one lateral edge of said tilt plate (45) to a distal end.

4. An apparatus as set forth in claim 3 including a pivotal joint defining an tilt axis (50) for rotating said crank arm (48) and said tilt plate (45) as a unit relative to said movable platen (43) about said tilt axis (50).

5. An apparatus as set forth in claim 4 wherein said mechanism includes at least one hydraulic cylinder (51) disposed above said movable platen (43) and having a first connection (52) to said distal end of said crank arm (48) and a second connection (53) to said movable platen (43) for rotating said crank arm (48) to thereby rotate said tilt plate (45) about said tilt axis (50) between said operating position and said loading position, said hydraulic cylinder (51) defining an actuation axis extending between said first connection (52) to said distal end of said crank arm (48) and said second connection (53) to said movable platen, said crank arm (48) having a crank arm axis (A) extending between said first connection (52) and said tilt axis (50).

6. An apparatus as set forth in claim 5 wherein said tilt axis (50) is disposed laterally outside of said operating area defined by said guide posts (38).

7. An apparatus as set forth in claim 6 wherein said tilt axis (50) is disposed vertically above said tilt plate (45).

8. An apparatus as set forth in claim 7 wherein said tilt plate (45) rotates through an angle of more than 90° from said operating position to said loading position.

9. An apparatus as set forth in claim 8 wherein the angle between said crank arm axis (A) and said actuation axis of said hydraulic cylinder (51) is less than 90° in said loading position.

10. An apparatus as set forth in claim 9 wherein the angle between said crank arm axis (A) and said actuation axis of said hydraulic cylinder (51) is less than 180° in said operating position.

11. An apparatus as set forth in claim 10 wherein said first connection (52) is disposed laterally outwardly from said tilt axis (50) in said operating position.

12. An apparatus as set forth in claim 11 wherein said first connection (52) is disposed inwardly of said guide posts (38) and above said movable platen (43) and in said operating area when in said loading position.

13. An apparatus as set forth in claim 12 wherein said crank arm axis (A) is disposed at an angle of 45° relative to vertical when in said operating position.

14. An apparatus as set forth in claim 13 wherein said tilt plate (45) moves through an angle of 105° between said operating position and said loading position.

15. An apparatus as set forth in claim 13 including a safety lock (59) for mechanically limiting the contraction of said hydraulic cylinder (51) to limit the rotation of said tilt plate (45) from said operating position to a cleaning position within said guide posts (38) and below said movable platen (43).

16. An apparatus as set forth in claim 2 including cope clamps (47) extending from said attachment surface for clamping the cope (36) to said attachment surface.

17. An apparatus as set forth in claim 16 including support locks for locking said tilt plate (45) to said movable platen (43) in said operating position.

18. An apparatus as set forth in claim 17 including drag clamps (58) extending from said base plate (32) for clamping the drag (34) to said base plate (32).

19. A low-pressure casting apparatus for conveying molten metal upwardly from a molten metal bath to a mold thereabove, said apparatus comprising:

a base plate (32) for supporting a drag (34) of a mold above the molten metal bath;

four guide posts (38) extending upwardly from said base plate (32) and defining a rectangular operating area therebetween;

a fixed platen (41) supported by said posts (38) in fixed vertical spacing above said base plate (32);

a movable platen (43) guided for vertical movement in said operating area by said guide posts (38) extending therethrough;

a ram actuator (39) interconnecting said fixed platen (41) and said movable platen (43) for moving said movable platen (43) vertically on said guide posts (38);

a tilt plate (45) presenting a downwardly facing attachment surface in said operating area under said movable platen (43) in an operating position for supporting a cope (36) of the mold under said movable platen (43);

said apparatus characterized by first and second pairs of spaced crank arms (48) extending laterally outwardly and then upwardly from one lateral edge of said tilt plate (45) to distal ends;

a tilt axis (50) pivot pin extending between each pair of said crank arms (48) and defining a tilt axis (50);

a pair of spaced flanges (49) extending outwardly from said movable platen (43) outside said operating area with one of said flanges (49) disposed between said first pair of crank arms (48) and surrounding said pivot pin (50) extending therebetween and the other flange (49) disposed between said second pair of crank arms (48) and surrounding said pivot pin (50) extending therebetween;

a first hydraulic cylinder (51) extending between a first connection (52) to said distal end of said first pair of crank arms (48) and a second connection (53) at the opposite lateral edge of said movable platen (43) and a second hydraulic cylinder (51) extending between a first connection (52) to said distal end of said second pair of crank arms (48) and a second connection (53) at said opposite lateral edge of said movable platen (43) for rotating said tilt plate (45) in an arc down and laterally outside of said operating area to a loading position outside of said guide posts (38) and with said attachment surface facing sufficiently upwardly to allow the cope (36) and drag (34) defining the mold to rest thereon under the force of gravity.

20. An apparatus as set forth in claim 19 wherein each of said hydraulic cylinders (51) defines an actuation axis extending between said first connection (52) thereof to said distal end of said crank arms (48) and said second connection (53) thereof to said movable platen (43), said crank arms (48) having a crank arm axis (A) extending between said first connections (52) and said tilt axis (50).

* * * * *